US005676570A

United States Patent [19]

Scherer

[11] Patent Number: 5,676,570

[45] Date of Patent: Oct. 14, 1997

[54] "F" PORT INTERFACE CONNECTOR

[75] Inventor: Richard J. Scherer, Austin, Tex.

[73] Assignee: Minnesota Mining and Manufacturing Company, St. Paul, Minn.

[21] Appl. No.: 617,992

[22] Filed: Mar. 15, 1996

[51] Int. Cl.[6] ..... H01R 11/09

[52] U.S. Cl. ..... 439/787; 439/857

[58] Field of Search ..... 439/787, 856, 439/857, 578, 675

[56] References Cited

U.S. PATENT DOCUMENTS

| | | | |
|---|---|---|---|
| 3,179,914 | 4/1965 | Uberbacher | 439/295 |
| 4,553,808 | 11/1985 | Weidler et al. | 439/857 |
| 4,607,907 | 8/1986 | Bogursky | 439/856 |
| 4,648,683 | 3/1987 | Botka et al. | 439/583 |
| 4,749,968 | 6/1988 | Burroughs | 333/105 |
| 4,897,045 | 1/1990 | Dyck | 439/578 |
| 4,932,891 | 6/1990 | Sparke et al. | 439/856 |
| 4,975,076 | 12/1990 | Mosquera | 439/387 |
| 5,007,865 | 4/1991 | Jakobert | 439/856 |
| 5,152,695 | 10/1992 | Grabbe et al. | 439/71 |
| 5,183,409 | 2/1993 | Clever | 439/291 |
| 5,184,965 | 2/1993 | Myschik et al. | 439/518 |
| 5,277,607 | 1/1994 | Thumma et al. | 439/188 |
| 5,338,215 | 8/1994 | Lee et al. | 439/188 |
| 5,366,382 | 11/1994 | Thumma | 439/188 |
| 5,378,164 | 1/1995 | Vidacovich et al. | 439/188 |
| 5,413,506 | 5/1995 | Thompson | 439/660 |
| 5,462,459 | 10/1995 | Childs | 439/856 |

*Primary Examiner*—Neil Abrams
*Assistant Examiner*—Barry M. L. Standig
*Attorney, Agent, or Firm*—Gary L. Griswold; Walter N. Kirn; Gerald F. Chernivec

[57] ABSTRACT

The method and system of the present invention provide an improved "F" port interface connector is provided having increased ampacity and greater reliability. The "F" port interface connector includes a generally cylindrical port having an insulative dielectric sleeve mounted therein. An electrically conductive spring contact is mounted within the dielectric sleeve. The spring contact includes two elongate elastically bendable conductive leaves which are mounted in a slightly mutually skewed relationship and each leaf includes a medial mating surface and a cam surface at one end. Each conductive leaf also includes a generally perpendicular conductive wing which is offset from the centerline of the leaf and disposed opposite a corresponding wing on the second leaf, such that upon insertion of a conductive wire between two cam surfaces and two generally perpendicular conductive wings the conductive leaves are simultaneously forced apart and toward longitudinal alignment, causing a lateral wiping action and increased electrical contact.

11 Claims, 3 Drawing Sheets

"F" PORT INTERFACE CONNECTOR

BACKGROUND OF THE INVENTION

1. Technical Field

The present invention relates in general to an improved female electrical connector and in particular to an improved "F" port connector for use with a coaxial cable. Still more particularly the present invention is directed to an improved electrical connection within an "F" port connector.

2. Description of the Related Art

Coaxial cable is typically utilized as a single transmitting wire or line. Those having ordinary skill in the art are familiar with coaxial cable and note that this type of cable typically consists of a central signal-conducting wire which is surrounded by a dielectric layer. The dielectric layer is further surrounded by a braided metal sheath, which is also an electrical conductor and the sheath is then covered by an outer layer of insulation.

In the past, sections of coaxial cable are typically connected together utilizing any one of a variety of devices including conventional threaded and twist-on couplings. A problem with couplings of this type is that they structurally connect one section of cable to another utilizing a temporary electrical connection between the hard center conductor of a coaxial cable and a plated conductive leaf spring. Each time such a connection is made the plating on the leaf spring is scythed and permanently damaged or completely removed as the center conductor of the coaxial cable enters and passes across the contact. Good connection between the hard center conductor and the leaf spring interface becomes more important as the signal frequency rises and there are also applications wherein large amounts of current will be passed through such a connector. Heat rise in the area of such a connector is significant if the connection has high resistance. The resistance of such a connection is in direct proportion to the resistivity divided by the distance across the contact area. Force applied and hardness at the contact area dictate the area of contact and the area and material resistivity dictate the contact resistance. Contact resistance and the amount of current flow dictate the temperature rise and the temperature and chemistry dictate the life of such a contact.

Early examples of such contacts are illustrated within U.S. Pat. Nos. 3,300,752 and 3,725,853 which disclose an electrical plug-in type connector which includes a movable and deformable metal socket. A plug which is inserted into the socket and pushed axially into the housing also pushes the socket inwardly. During this movement the socket has fillets made of leaf spring material which cam against convergent services in the housing. This causes such fillets to converge and grip the male plug.

U.S. Pat. No. 4,897,045 discloses a wire-seizing connector for use with coaxial cable which attempts to enhance the electrical connection in such a connector by providing a plug element which may be operated to laterally move wire-seizing elements into tighter contact with the central conductor of a coaxial cable. While these connectors have been extensively utilized in the past the higher frequencies prevalent in the modern electronic environment and the increased amounts of power passed through such connections dictates the provision of an enhanced "F" port connector for such applications.

It is should therefore be apparent that a need exists for an improved "F" port interface connector having increased ampacity and greater reliability.

SUMMARY OF THE INVENTION

It is therefore one object of the present invention to provide an improved female electrical connector.

It is another object of the present invention to provide an improved "F" port connector for use with a coaxial cable.

It is yet another object of the present invention to provide an improved electrical connection within an "F" port connector.

The foregoing objects are achieved as is now described. An improved "F" port interface connector for receiving a male coaxial cable connector is provided having increased ampacity and greater reliability. The "F" port interface connector includes a generally cylindrical port having an insulative dielectric sleeve mounted therein. An electrically conductive spring contact is mounted within the dielectric sleeve. The spring contact includes two elongate elastically bendable conductive leaves which are mounted in a slightly mutually skewed relationship. Each leaf includes a medial mating surface and a cam surface at one end. Each conductive leaf also includes a generally perpendicular conductive wing which is offset from the centerline of the leaf and disposed opposite a corresponding wing on the second leaf, such that upon insertion of a conductive wire between two cam surfaces and the two generally perpendicular conductive wings, the conductive leaves are simultaneously forced apart and toward longitudinal alignment, causing a lateral wiping action and increased electrical contact.

The above as well as additional objectives, features, and advantages of the present invention will become apparent in the following detailed written description.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION OF PREFERRED EMBODIMENT

Figure 1:
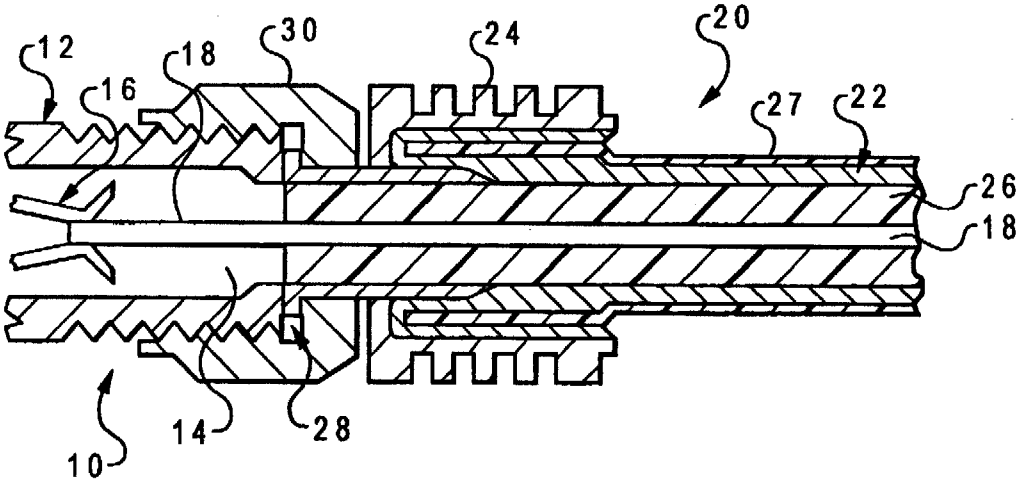
Fig. 1 Prior Art
FIG. 1 is a sectional view of a prior art "F" port connector.

With reference now to the figures and in particular with reference to FIG. 1, there is illustrated a sectional view of a prior art "F" port connector 10. As illustrated, "F" port connector 10 includes a generally cylindrical port 12, a dielectric sleeve 14, and a spring contact 16. Illustrated in a conductive connection with "F" port connector 10 is a coaxial cable 20. As those skilled in the art will appreciate, coaxial cable 20 includes a center conductive wire 18 which is surrounded by a dielectric layer 26 and a conductive braid 22 and an insulated sleeve 27. A body 24 is fixed to one end of coaxial cable 20 in a manner well known in the art and a mandrel 28 and nut 30 are then utilized to physically secure coaxial cable 20 to "F" port connector 10. As depicted, conductive wire 18, when coaxial cable 20 is mated to "F" port connector 10, is inserted into electrical contact with spring contact 16 in a manner which will be illustrated in greater detail herein.

Figure 2:
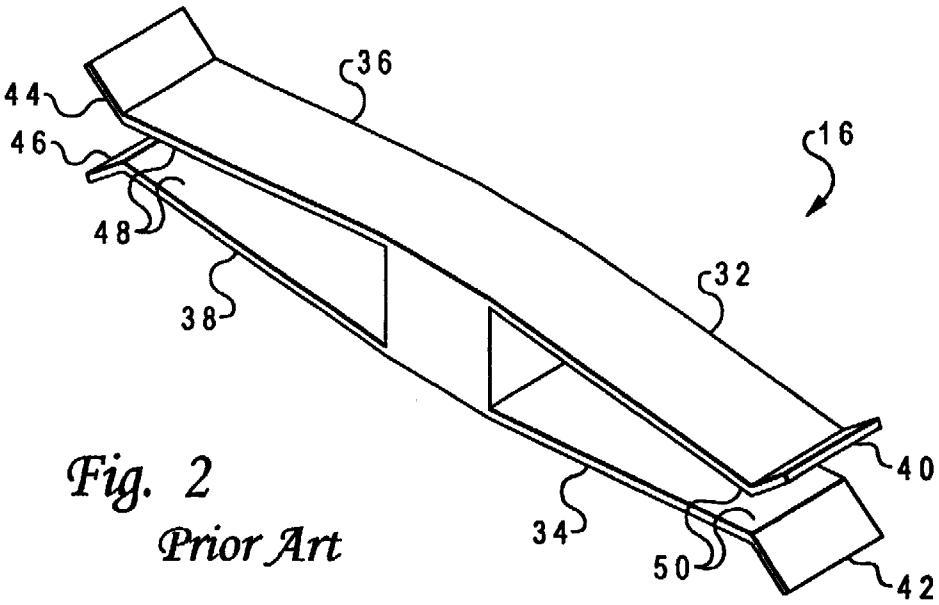
Fig. 2 Prior Art
FIG. 2 is a perspective view of a spring contact member utilized in the prior art "F" port connector of FIG. 1.

Referring now to FIG. 2 there is depicted a perspective view of a spring contact member utilized in a double ended prior art "F" port connector, one end of which is depicted in FIG. 1. As illustrated, spring contact 16 is constructed of electrically conductive material, such as beryllium copper, and includes a plurality of elongate elastically bendable conductive leaves such as conductive leaves 32, 34, 36 and 38. As further depicted, each conductive leaf includes a cam surface at one end thereof, such as cam surfaces 40, 42, 44 and 46. A medial mating surface is also provided on each elongate leaf. Thus, a pair of medial mating surfaces 48 are disposed adjacent one another and a pair of medial mating surfaces 50 are disposed adjacent one another. Thus, referring to FIGS. 1 and 2, the insertion of a conductive wire 18 into one end of the "F" port connector will urge the end of conductive wire 18 into contact with cam surfaces 40 and 42, for example, forcing elongate leaves 32 and 34 apart and permitting conductive wire 18 to be inserted between the pair of medial mating surfaces 50. Thereafter, electrical contact is maintained between the conductive wire and spring contact 16 via the physical proximity of the conductive wire to the pair of medial mating surfaces 50.

The electrical connector illustrated within FIGS. 1 and 2 is well known in the prior art and those skilled in the art will appreciate that each insertion of a conductive wire into the "F" port connector of FIG. 1 will result in a scything of the plating on spring contact 16 which may permanently damage or completely remove that plating from spring contact 16 in the area of contact between conductive wire 18 and spring contact 16. Consequently, the electrical connection between conductive wire 18 and spring contact 16 may be physically degraded and thermal and/or corrosive failure of "F" port connector 10 may occur as a result of such damage.

Figure 3:
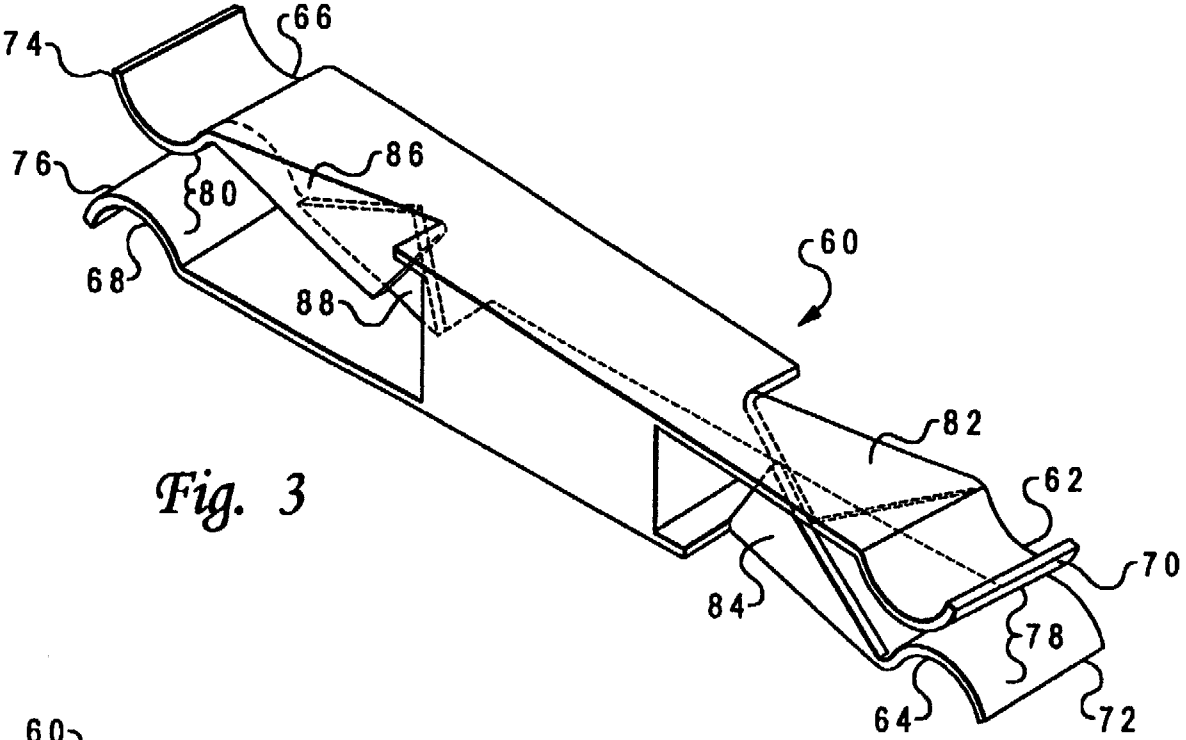
FIG. 3 is a perspective view of a spring contact member provided in accordance with the present invention.

With reference now to FIG. 3 there is depicted a perspective view of a novel spring contact member 60 which provided in accordance with the present invention. In a manner similar to that depicted within FIG. 2, spring contact 60 comprises an electrically conductive spring contact, constructed of a suitable electrically conductive material such as beryllium copper or phosphor bronze. Spring contact 60 also includes a plurality of elongate elastically bendable conductive leaves. Conductive leaves 62, 64, 66, and 68 are depicted in pairs which are generally diametrically opposed.

As above, each elongate conductive leaf 62, 64, 66 and 68 includes an associated cam surface 70, 72, 74 and 76 at a distal end thereof and a pair of medial mating surfaces 78 and 80 between each two elongate conductive leaves.

Additionally, in accordance with an important feature of the present invention, each elongate conductive leaf includes a conductive wing, such as conductive wings 82, 84, 86 and 88. As illustrated, each conductive wing is mounted to the medial mating surface of an associated conductive leaf and, angularly displaced in manner which will be illustrated in greater detail in FIG. 4.

Figure 4:
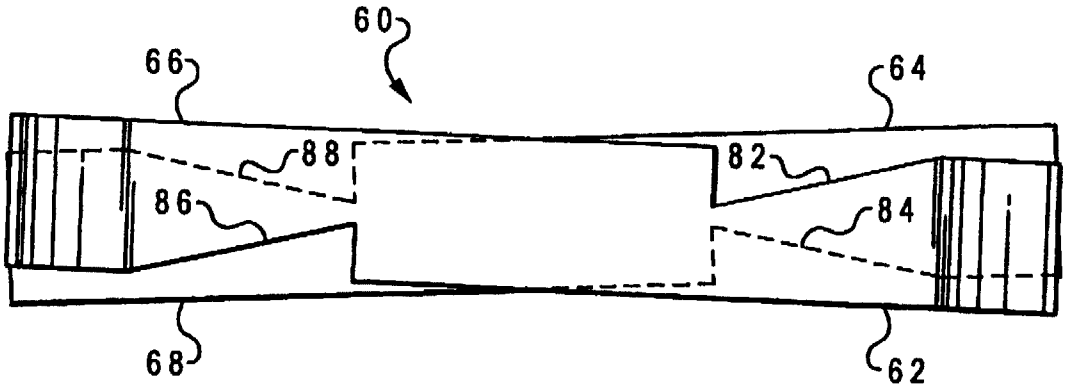
FIG. 4 is a top plan view of the spring contact member of FIG. 3.

Referring now to FIG. 4, there is depicted a top plan view of the spring contact member 60 of FIG. 3. As illustrated within FIG. 2, each pair of elongate conductive leaves is mounted in a slightly mutually skewed relationship. That is, elongate conductive leaf 62 is slightly skewed from the axis of elongate conductive leaf 64. Similarly, elongate conductive leaf 66 is slightly skewed from the axis of elongate conductive leaf 68 at an angle of between 1° and 7° and preferably from 2° to 5°. Further, as illustrated more clearly within FIG. 4, the angle at which each conductive wing is mounted from the longitudinal axis of spring contact 60 is apparent. This angle is preferably chosen to allow initial insertion of a conductive wire between two conductive wings. This mounting is an important feature of the present invention as will be further illustrated within FIGS. 5 and 6. It should also be noted that physical isolation between opposite ends of spring contact member 60 may be obtained by providing a slit between conductive leaves 66 and 62.

Figure 6:
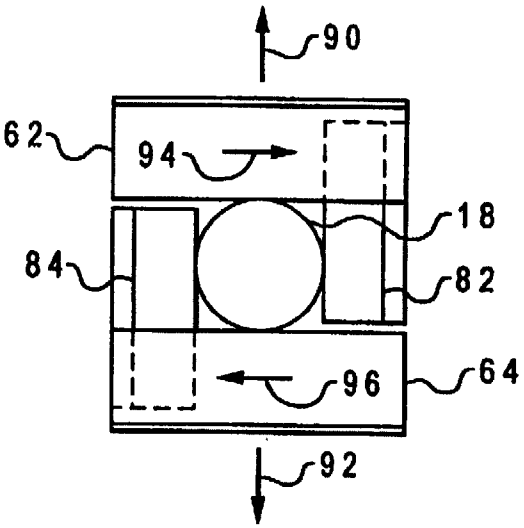
FIG. 6 is an end view of one end of the spring contact member of FIG. 3 illustrating full insertion of a conductive wire.
Figure 5:
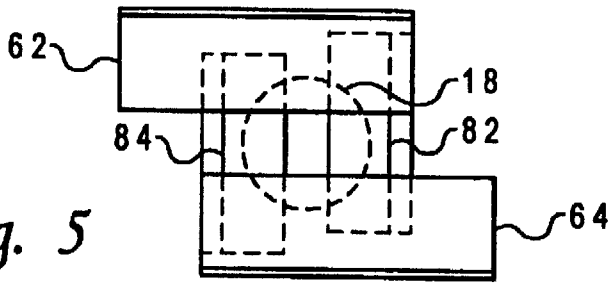
FIG. 5 is an end view of one end of the spring contact member of FIG. 3 illustrating the initial insertion of a conductive wire.

Referring now to FIGS. 5 and 6, there is depicted an end view of one end of spring contact 60 of FIG. 3 illustrating the initial insertion and full insertion of a conductive wire. As depicted within FIG. 5, the skewed relationship of elongate conductive leaves 62 and 64 is depicted. Further, each conductive wing 82 and 84 is also illustrated. As depicted within FIG. 5, upon an initial insertion of a conductive wire 18 between the cam surfaces of elongate conductive leaves 62 and 64 these leaves will begin to spread apart. Next, as illustrated in greater detail within FIG. 6, the angular placement of conductive wings 82 and 84 cause conductive wings 82 and 84 to physically contact conductive wire 18. Further insertion of conductive wire 18 against angled, conductive wings 82 and 84 will result in a wiping action which is depicted by the arrows denoted by reference numerals 90, 92, 94 and 96.

Thus, upon reference to this illustration it should be apparent that full insertion of conductive wire 18 between elongate conductive leaves 62, and 64 will result in the separation of elongate conductive leaves 62, and 64, as depicted at arrows 90 and 92. Further, the insertion of conductive wire 18 between conductive wings 82, and 84 will result in a lateral movement of elongate conductive leaves 62, and 64, urging elongate conductive leaves 62 and 64 toward longitudinal alignment, as illustrated at arrows 94 and 96.

Upon reference to the present specification and upon viewing the illustrations contained within FIGS. 5 and 6, those having ordinary skill in the art will appreciate that upon full insertion of a conductive wire into one end of spring contact 60 within the novel "F" port interface connector of the present invention will result in an enhanced electrical connection due to the fact that conductive wire 18 will be in electrical contact with not only elongate conductive leaves 62, and 64, but also conductive wings 82 and 84. Further, the wiping action illustrated within FIGS. 5 and 6 will result in the final electrical contact point between conductive wire 18 and elongate conductive wings 62, and 64 being at a different point than the initial insertion point, such that fresh, undamaged contact plating is in place over both the top and bottom of conductive wire 18. In this manner the novel "F" port interface connector of the present invention provides greater ampacity and improved reliability over known "F" port interface connectors.

Figure 7:
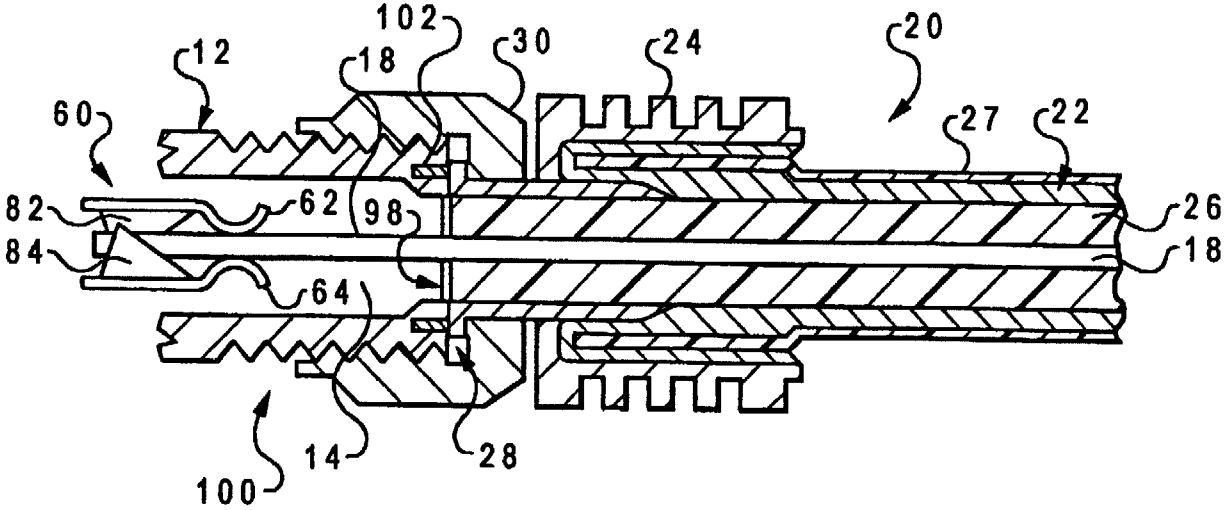
FIG. 7 is a sectional view of an "F" port connector provided in accordance with the present invention.

Finally, with reference to FIG. 7 there is depicted a sectional view of one end of an "F" port connector provided in accordance with the present invention. In a double ended connector the opposite end is identical, when utilizing a spring contact as illustrated in FIG. 4. Those components within novel "F" port connector 100 depicted within FIG. 7 which are identical to those components in the prior art "F" port connector depicted within FIG. 1 are labeled with the same reference numerals for ease of illustration.

Thus, as illustrated within FIG. 7, "F" port connector 100 includes a generally cylindrical port 12, a dielectric sleeve 14 and a novel spring contact 60. Illustrated in a conductive connection with "F" port connector 100 is coaxial cable 20. As described above, coaxial cable 20 typically includes a center conductive wire 18 which is surrounded by a dielectric layer 27 and a conductive braid 22. Dielectric layer 27 and dielectric sleeve 14 are preferably provided utilizing polyethylene, polypropylene or other suitable dielectric material. A body 24 is fixed to one end of coaxial cable 20 in a manner well known in the art and a mandrel 28 and nut 30 are then utilized to physically secure coaxial cable 20 to "F" port connector 100. As depicted, conductive wire 18, when coaxial cable 20 is mated to "F" port connector 100, is inserted into electrical contact with spring contact 60 in the manner described above with respect to FIGS. 5 and 6. As illustrated, conductive wire 18 makes contact with medial mating surfaces 62 and 64 as well as with conductive wings 82 and 84. Additionally, the impedance between dielectric sleeve 14 and dielectric layer 26 is maintained at 75 ohms by utilizing a moisture sealing gel or grease 98 having a low dissipation factor or loss tangent which will cause dielectric sleeve 14 and dielectric layer 26 to transition to each other, avoiding return losses. The layer of impedance matching gel preferably has a Dissipation Factor at or lower than 0.0016 at 100 kilohertz in accordance with ASTM D-150. An appropriate impedance matching gel is silicone gel which may be formulated with the desired Dissipation Factor.

Additionally, moisture protection for "F" port connector 100 can be enhanced by providing a ring 102 which is attached or loosely placed at the interface of the mandrel 28 and cylindrical port 12. By formulating ring 102 out of a soft conductive material RF blocking can be provided in addition to moisture protection. An excellent example of such a material is illustrated in U.S. patent application Ser. No. 08/412,966, filed Mar. 29, 1995 and assigned to the assignee herein named. By utilizing ring 102 which includes conductive properties the torque necessary for a good RF seal can be greatly reduced.

Thus, as illustrated within FIG. 7 an enhanced "F" port connector can be provided which includes a more reliable electrical connection and increases the overall reliability of the "F" port connector. A double ended "F" port connector may be provided by utilizing spring contact member 60 of FIG. 4 to provide a mirror image end for "F" port connector 100.

While the invention has been particularly shown and described with reference to a preferred embodiment, it will be understood by those skilled in the art that various changes in form and detail may be made therein without departing from the spirit and scope of the invention.

I claim:

1. An improved female connector for making an electrical connection with a male element, comprising:

a port;

an insulative dielectric sleeve within said port; and an electrically conductive spring contact member mounted within said insulative dielectric sleeve, said electrically conductive spring contact member including:

first and second elongate elastically bendable conductive leaves mounted in a slightly mutually skewed relationship;

each conductive leaf including a medial mating surface and a cam surface at a distal end thereof;

said first conductive leaf including a conductive wing mounted thereto offset from a centerline thereof and disposed diametrically opposite a corresponding conductive wing mounted on said second conductive leaf, such that upon insertion of a male element between said cam surfaces of said conductive leaves and said conductive wings said conductive leaves are simultaneously forced apart and toward longitudinal alignment wherein said male element is held in electrical contact with each medial mating surface and both of said conductive wings.

2. The improved female connector according to claim 1, wherein said improved female connector comprises an "F" port connector and wherein said port comprises a generally cylindrical rigid port.

3. The improved female connector according to claim 2, wherein said male element comprises a conductive wire mounted within a dielectric layer in a coaxial cable.

4. The improved female connector according to claim 1, wherein said electrically conductive spring contact member is constructed of beryllium copper.

5. The improved female connector according to claim 1, wherein said electrically conductive spring contact member is constructed of phosphor bronze.

6. The improved female connector according to claim 3, further comprising an impedance matching gel disposed between said dielectric layer and said insulative dielectric sleeve.

7. The improved female connector according to claim 6, wherein said impedance matching gel has a dissipation factor at or lower than 0.0016 at 100 kilohertz.

8. A double ended "F" port connector for making an electrical connection between two coaxial cables comprising:

a generally cylindrical port;

an insulative dielectric sleeve within said generally cylindrical rigid port; and an electrically conductive spring contact member mounted within said insulative dielectric sleeve, said electrically conductive spring contact member including:

first and second elongate elastically bendable conductive leaves mounted in a slightly mutually skewed relationship;

third and fourth elongate elastically bendable conductive leaves mounted in a slightly mutually skewed relationship diametrically opposed to said first and second elongate elastically bendable conductive leaves;

each conductive leaf including a medial mating surface and a cam surface at a distal end thereof;

said first conductive leaf including a conductive wing mounted thereto offset from a centerline thereof and disposed diametrically opposite a corresponding conductive wing mounted on said second conductive leaf;

said third conductive leaf including a conductive wing mounted thereto offset from a centerline thereof and disposed diametrically opposite a corresponding conductive wing mounted on said fourth conductive leaf;

such that upon insertion of a conductive wire between said cam surfaces of either said first and second conductive leaves or said third and fourth conductive leaves said conductive leaves are simultaneously forced apart and toward longitudinal alignment wherein said conductive wire is held in electrical contact with each medial mating surface and both of said conductive wings.

9. The improved female connector according to claim 8, wherein said improved female connector comprises an "F" port connector and wherein said port comprises a generally cylindrical rigid port.

10. The improved female connector according to claim 8, further including an impedance matching gel disposed on each end of said insulative dielectric sleeve.

11. The improved female connector according to claim 10, wherein said impedance matching gel has a dissipation factor at or lower than 0.0016 at 100 kilohertz.

* * * * *